United States Patent [19]

Miura

[11] Patent Number: 4,485,497

[45] Date of Patent: Dec. 4, 1984

[54] APPARATUS FOR CONTROLLING RE-DISTRIBUTION OF LOAD ON CONTINUOUS ROLLING MILL

[75] Inventor: Keiichi Miura, Kobe, Japan

[73] Assignee: Mitsubishi Denki Kabushiki Kaisha, Tokyo, Japan

[21] Appl. No.: 287,761

[22] PCT Filed: Dec. 23, 1980

[86] PCT No.: PCT/JP80/00320

§ 371 Date: Jul. 28, 1981

§ 102(e) Date: Jul. 28, 1981

[87] PCT Pub. No.: WO81/01805

PCT Pub. Date: Jul. 9, 1981

[30] Foreign Application Priority Data

Dec. 27, 1979 [JP] Japan ..... 54-170738

[51] Int. Cl.[3] ..... G06F 15/46

[52] U.S. Cl. ..... 364/469; 364/472; 364/476; 72/6; 72/8; 72/11; 72/16; 72/240; 72/245

[58] Field of Search ..... 364/469, 472, 476; 72/6, 8, 11, 12, 17, 16, 19, 234, 240, 245

[56] References Cited

U.S. PATENT DOCUMENTS

| | | | |
|---|---|---|---|
| 3,355,918 | 12/1967 | Wallace . | |
| 3,387,470 | 6/1968 | Smith, Jr. . | |
| 3,574,280 | 4/1971 | Smith, Jr. | 72/8 |
| 3,592,031 | 7/1971 | Sutton | 72/8 |
| 3,641,325 | 2/1972 | Arimura et al. | 235/151.1 |
| 3,694,636 | 9/1972 | Smith, Jr. | 235/151.1 |
| 3,787,667 | 1/1974 | King et al. | 235/151.1 |
| 3,906,764 | 9/1975 | Mueller | 72/8 |
| 3,913,363 | 10/1975 | Fujii et al. | 72/10 |
| 4,037,087 | 7/1977 | Foulds | 235/151.1 |
| 4,087,859 | 5/1978 | Anbe | 364/472 |
| 4,137,742 | 2/1979 | Tanifuji et al. | 72/6 |
| 4,199,967 | 4/1980 | Ikemi et al. | 72/12 |
| 4,240,147 | 12/1980 | Morooka et al. | 364/472 |
| 4,261,190 | 4/1981 | Fapiano | 72/6 |
| 4,292,825 | 10/1981 | Morooka et al. | 72/8 |
| 4,335,435 | 6/1982 | Miura | 364/469 |

OTHER PUBLICATIONS

A. F. MacAlister and G. G. Eades, "Current Trends in Modern Hot-Strip Mill Automation" GEC Journal of Science & Technology, vol. 44, No. 3, 1978, pp. 123-135.

*Primary Examiner*—James D. Thomas
*Assistant Examiner*—Archie E. Williams, Jr.
*Attorney, Agent, or Firm*—Wenderoth, Lind & Ponack

[57] ABSTRACT

An apparatus, for controlling the re-distribution of a load in a longitudinal direction of a single strip (which is called hereinafter within the plate) on a multistage continuous rolling mill, stores a standard expression of the distribution of the load for maintaining a product's shape constant within the plate. A screw-down correction computer system calculates deviations from this reference equation and controls a rolling force on each of the rolling mills. It thereby maintains the standard expression of the distribution of the load by iteratively correcting a roll opening on each of the rolling mills within the plate. The control of the load distribution among the roll stands is effected after the roll material has entered all of the roll stands.

2 Claims, 6 Drawing Figures

APPARATUS FOR CONTROLLING RE-DISTRIBUTION OF LOAD ON CONTINUOUS ROLLING MILL

BACKGROUND OF THE INVENTION

1. Field of the Invention

This invention relates to a multistage continuous rolling mill, and more particularly to a system for controlling the re-distribution of a load in a longitudinal direction of a single strip (which is called hereinafter within the plate) on a continuous hot rolling mill. More specifically, it concerns a re-distribution-of-load control apparatus for maintaining a predetermined ratio of the distribution of a rolling force to a multistage continuous rolling mill comprising an automatic screw-down setting device and a master drive control for the rolling mill and for preventing the shape of a product and more particularly the flatness thereof from deteriorating within the plate or suppressing an inclination of a rolling load toward a specified rolling mill.

2. Description of the Prior Art

The distribution of a load (a load called herein implies a rolling force) to each of a plurality of roll stands on a continuous rolling mill is an extremely important subject in view of the standpoint of the ensuring of a product's shape and the maintenance of the smooth operation thereof. In conventional continuous rolling mills, for example, continuous hot rolling mills, therefore, the distribution of a load to each stand which has been predetermined through an initial setting calculation (the setting before the metal-in-stand) so that it is preliminarily of a proper ratio but the exact control has not been effected with respect to the monitoring and correcting of the distribution of the rolling force in a longitudinal direction of a material after the rolling of the material has been initiated, which is called the passage of the plate.

On the other hand, the material rolling conditions are momentaly changed within the plate of a material for both the main causes on the side of the material and those on the side of the rolling mill. As a result, it is natural that the distribution of the load to each rolling mill is also varied upon and after the initial setting.

This situation is described by taking the case of a conventional hot finish rolling mill as shown in FIG. 1. In FIG. 1, element 1 designates a working roll on the hot finish rolling mill; element 2 is a backup roll; element 3 is an automatic roll-opening positioning device; element 4 is a main control system for the driving speed of the rolling mill; element 5 is a looper which is located between stands; element 6 is a looper height control system, element 7 is a rolling force sensor (a load cell); element 8 is an automatic gauge control device (which is called an RF·AGC); element 9 is a monitor AGC device; element 10 is a high speed X-ray AGC device; element 11 is a product gauge sensor disposed adjacent to the exit side of the finish rolling mill and S designates a rolled material (i.e. a strip). In FIG. 1, the strip S is successively gripped by stands of from $F_1$ to $F_7$ and as a result, a preliminarily estimated rolling force Pi is generated on the load cell 7 on each stand. When the strip S is gripped by each stand, the RF·AGC provided on each stand is actuated so as to tend to maintain an exit gauge on each stand at a stored value (which is called a lock-on value) at the beginning of a passage of the plate. Also, upon the strip S reaching the product gauge sensor 11, the monitor AGC device 9 and the high speed X-ray AGC device 10 are further actuated to control the final product's gauge to be held at a predetermined absolute gauge. Also, in order to maintain the tension between the stands at a constant value and to render the mass flow between the stands at a constant value in the steady state, the looper 5 is present and the looper height control system 6 effects the fine adjustment of each speed control system 4 for the rolling mill.

While the hot finish rolling proceeds as described above, the material on the entry side of the finishing stand has a temperature drop due to the heat dissipation, for example, and, as the trailing end of the plate is reached, the temperature member lowers in temperature. On the other hand, the temperature of the plate adjacent to the last stand is held substantially constant as a result of the temperature control of the material on the finishing exit side, which control being effected by the acceleration of the rolling mill, the flooding between the rolling mills, etc. This results in a rise in the plastic coefficient of the material on the first half of the stands and also results in the rolling forces becoming large. FIG. 2 is an example of the actual measurement conducted with respect to the temperatures of a random sampled member on the entry and exit sides of a finishing stand. A temperature difference of about 100° C. exists between the leading and trailing ends of the material on the entry side and an increase in rolling force of about 400 tons at the $F_1$ mill results in an increase of about 20% from the rolling force at the beginning of a metal-in-stand. On the other hand, the range of variations in the exit temperature is about 20° C. and consequently, a variation in the rolling force is about 10%.

Considering also the AGC operation, the RF·AGC, for example, does not take account the mutual load balance among the stands because the gauge control is independently effected for each stand. FIG. 3 is a block diagram illustrating the principles of the RF·AGC wherein 31 is the characteristics of the rolling mill; 32 is a mill elongation percentage (the reciprocal of a mill elastic constant); 33 is a tuning percentage; 34 is a lock-on value memory; 35 is a gain (a coefficient of influence); and 36 is the modeled characteristics of an automatic screw-down position setting device for the rolling mill. In this system it is well known that the construction is such that the main body of the rolling mill is regarded as an elastic body, and a screw-down position (S) is thereby so as corrected to compensate for an elongation (P/M) of a mill housing due to a rolling force, and the exit gauge on the rolling mill is maintained constant. In this system, $\alpha$ of the element 33 in FIG. 3 is a positive constant called the tuning percentage and since it is approximately equal to 1, the ability to fully absorb the mill elongation so as to maintain the gauge on the last exit side constant becomes high. However, if $\alpha$ is selected to be 1, then a rise in the rolling force which is due to, for example, the abovementioned temperature fall of the plate on the entry side, results in a further increase in the rolling force. (If the rolling force increases in the RF·AGC, then an screw-down opening is controlled so as to be correspondingly small so that the rolling force is further increased.) With the distribution of the rolling force in view, it is normally used as $\alpha < 1$. That is, with the RF·AGC operated, the distribution of the rolling force among the individual stands is varied by selecting the tuning percentage $\alpha$ thereof. Further considering the feedback control from the last exit gauge sensor, the stands in the later stage are controlled by putting relative importance on the high speed response characteristic because a gauge deviation is absorbed at a high speed whilst the first half of the stands does not increase in control gain and is slowly controlled because there is a time delay for sensing a signal (i.e. a transportation delay). Therefore, if an initial setting calculation, for example, has a large error, then the second half of the stands is apt to have their rolling forces increase and furthermore, a ratio of the distribution thereof is dependent upon the selection of a feedback gain with the result that the rolling force on each stand is varied with respect to a value of the feedback gain. Assuming, for example, that the feedback has been concentrated on the last stand $F_7$, and assuming that the setting calculation has an error of 200$\mu$ (0.2 mm), then if the mill constant is 600 tons/mm and the plastic coefficient is 500 tons/mm, then a rise in the rolling force on $F_7$ is about $0.2\times(600+500)=220$ tons which is not permissible.

With the progress of the rolling, the distribution of the load to each rolling mill of the continuous rolling mill is gradually varied in this way within the plate and if such a variation in distribution of the load is left as it is, then this has given rise to the deterioration of the shape (i.e. flatness) of the final product or the concentration of the load on a specified stand so as to deteriorate the quality of the product and, in addition, has been the main cause for preventing the rolling mill from increasing its operational efficiency.

SUMMARY OF THE INVENTION

The present invention has been made in order to eliminate the disadvantages of the prior art practice as described above and aims at the provision of a re-distribution-of-load control apparatus for controlling the distribution of a rolling force in a longitudinal direction within the plate to each rolling mill to a predetermined ratio so as to thereby prevent the concentration of the rolling force on a specified stand and the deterioration of a product's shape.

According to the present invention, it is possible to maintain the distribution of a rolling force among stands in a longitudinal direction of a material throughout the length thereof at a predetermined ratio and avoid the deterioration of a product's shape and avoid the concentration of the rolling force on a specified stand. The application of the system of the present invention also causes part of the AGC control to be released from its requirement to maintain the balance of a load so as to permit a tuning percentage, a feedback gain, etc. to be optimally selected. Therefore, it is possible to improve the control effect concerning, for example, a skid mark and to increase the gauge accuracy. In addition, the effect due to the application of the present invention causes a wide variety of improvements in the finished product quality, and an increase in the operation degree yield.

DESCRIPTION OF THE PREFERRED EMBODIMENT

Figure 1:
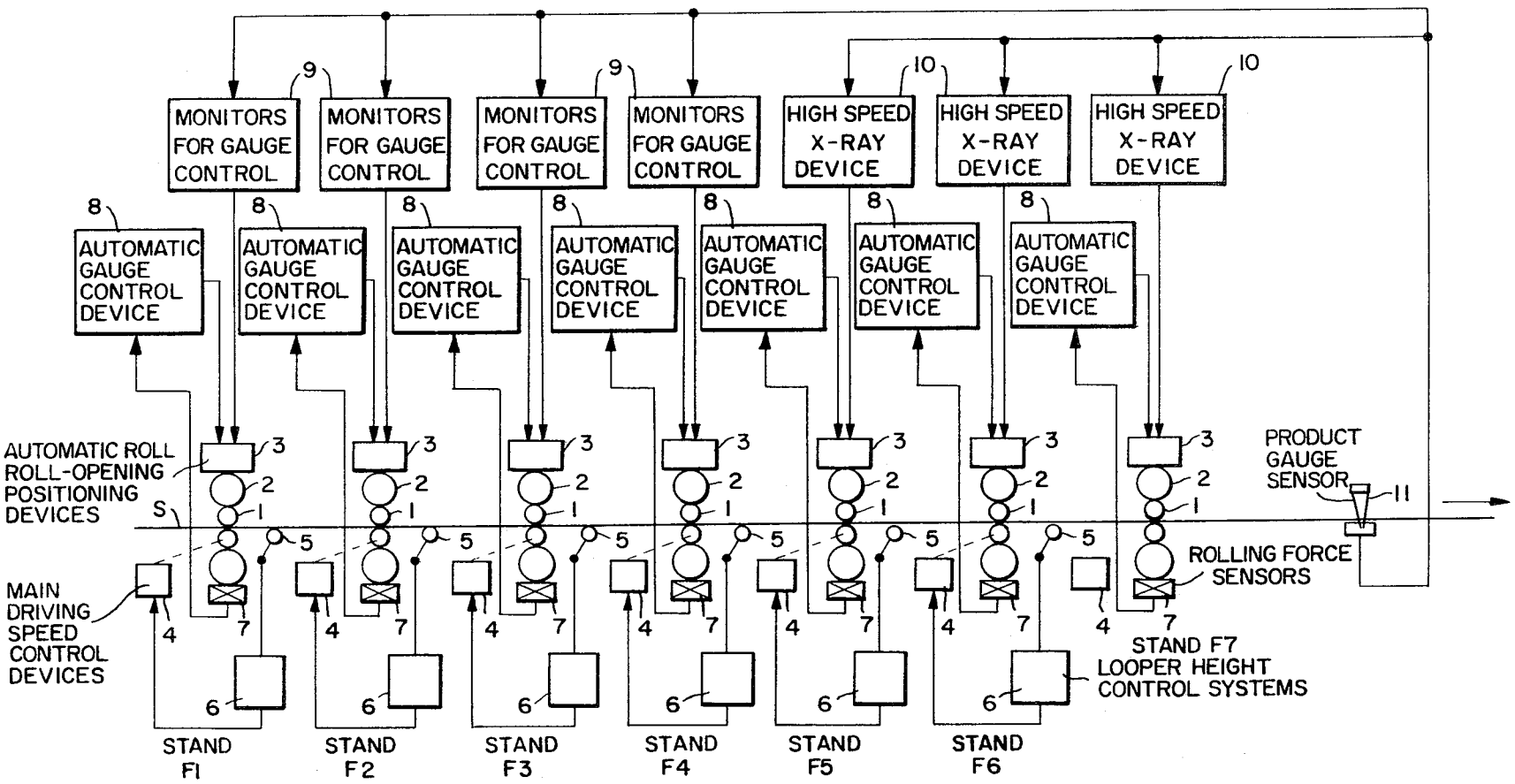
FIG. 1. (PRIOR ART)
FIG. 1 is a view illustrating a conventional control system for a continuous hot finish rolling mill.
Figure 2:
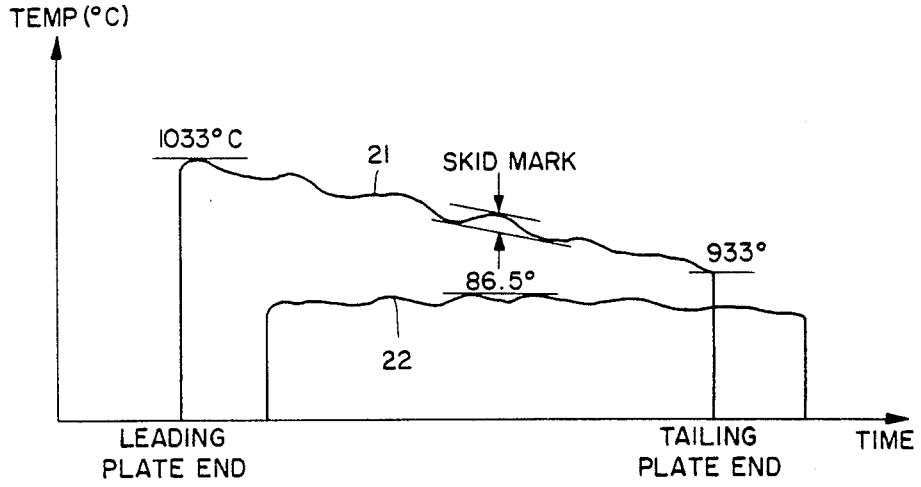
FIG. 2. (PRIOR ART)
FIG. 2 is a diagram illustrating an example of a chart of temperatures of a material on the entry and exit sides of a hot finish rolling mill actually measured by thermometers.
Figure 3:
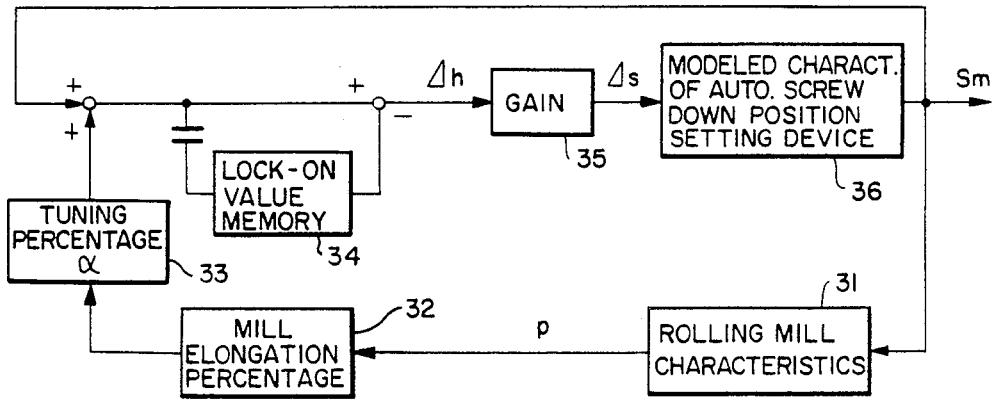
FIG. 3. (PRIOR ART)
FIG. 3 is a block diagram of an AGC control system according to a gauge meter system.

An embodiment of the present invention is described in detail below.

The re-distribution-of-load control is important so as to prevent a product's shape from deteriorating within the plate due to a variation in distribution of a rolling force. To this end, it is necessary to hold the varied rolling components on each of the roll stands in a predetermined relationship with one another. As to the mutual relationship of this variation in rolling force among the stands, one may use his or her way of thinking, for example, a quantity of a relative crown. An abnormality in the flatness of a product's shape is due to an unequal elongation percentage in a direction of width of a plate which, in turn generates an internal stress in the plate. An internal stress which is in excess of a constant limit results in an inferior plate shape such as wavy edges, center buckles or the like. When the conditions for making this flatness acceptable are expressed by the fact that the central portion of the plate is equal in its elongation percentage to the end portion thereof, it is well known that there is derived a constant relative crown system expressed by the following expression (1):

$$\frac{Cri-1}{hi-1}=\frac{Cri}{hi} \tag{1}$$

where

Cri/hi: quantity of relative crown of plate on exit side of i-th stand $Cri_{-1}=hci_{-1}-hei_{-1}$: plate crown on exit side of (i−1)-th stand Cri=hci−hei: i-th stand $hi-1=(hci_{-1}+hei_{-1})/2$: average gauge on exit side of (i−1)-th stand hi=(hci+hei)/2: average gauge on exit side of i-th stand $hci_{-1}$ and hci: central gauges on cross sections on exit side of (i−1)-th and i-th stands $hei_{-1}$ and hei: end gauges on exit sides of (i−1)-th and i-th stands.

This plate crown Cri on the exit side of each stand is determined by the rolling force, a roll crown and other roll conditions. In hot rolling, its relational expression may be approximated, for example, by the following expression (2):

$$Cri=\alpha pi\cdot Pi-\alpha CBi\cdot RCBi-\alpha CWi\cdot RCWi-\alpha Bi\cdot PBi \tag{2}$$

where Pi: rolling force; PBi bending force; RCBi: crown of backup roll; RCWi: crown of working roll; $\alpha$pi, $\alpha$CBi, $\alpha$CWi and $\alpha$Bi: coefficients determined by the rolling conditions.

As have been previously described in conjunction with the control of the hot finish rolling mill, the rolling force on each rolling mill is varied within the plate and as is apparent from the expression (2), this change causes a variation in the plate crown Cri on the exit side of each stand. As a result, a relative crown Cril/hi thereof is also changed from its value at the initiation of the rolling. If, at that time, quantities of the relative crown on the stands are varied independently of one another then it is apparent that the conditions for maintaining the shape as expressed by the expression (1) are not satisfied. Thus, the conditions for maintaining a product's shape within the plate result in the following expression (3):

$$\Delta\left(\frac{Cri-1}{hi-1}\right)=\Delta\left(\frac{Cri}{hi}\right) \tag{3}$$

where Δ is a quantity which is changed from that at the initiation of the rolling (which is called hereinafter an initial value).

While expression (2) causes expression (3) to establish relationships, with expression (3) the roll crowns (RCBi and RCWi) in expression (2) have negligible changes within the plate. Also, since a roll bender value is normally constant with a single material, a change in plate crown Cri is determined principally by a change in rolling force. That is, the expression (4) results.

$$\Delta CRi=\alpha pi\cdot\Delta Pi \tag{4}$$

In the normal hot rolling, the gauge on the exit side of each stand is maintained substantially constant as a result of the automatic gauge control on each stand, and a change in exit gauge has a small influence upon the expression (3). Also, a coefficient αpi on the righthand side of the expression (4) is a coefficient flexure of the roll on the rolling mill due to the rolling force and this value exhibits a substantially equal value as long as various parameters of the rolling mill remain unchanged. Thus, the expression (3) may be simplified to the expression (5).

$$\frac{\Delta Pi-1}{hi-1}=\frac{\Delta Pi}{hi} \tag{5}$$

That is to say, it becomes apparent that the expression (3) or the expression (5) to which it has been simplified may be used as the fundamental expression for controlling the distribution of the rolling force in order to prevent the shape from deteriorating within the plate. While it has been assumed that, as the premise for making the expressions (3) to (5) the conditions necessary for maintaining the shape, the right shape is given with the distribution of the rolling force at a time point where the rolling is initiated (an initial time point); this is to be realized through an initial setting calculation or through the intervention of a manual operation by the operator immediately after the passage of a plate and thereafter, the control of the re-distribution of a load is initiated.

Now while the foregoing has indicated a standard expression for controlling the re-distribution of the load in order to maintain the shape of the product, that standard expression is to be mainly applied to last several stands and a different standard expression is applied to the first half of the stands. This is because of the fact that due to the thick gauge of the material on the first half of the stands, the internal stress is absorbed by a metal flow (a lateral stream) of the rolled material and the flatness thereof is not deteriorated. Under those conditions, it is not necessary to meet the constant relative crown condition of the expression (1) and rather one should determine the re-distribution of the rolling force for stably maintaining the rolling operation within ranges such as the limits of a rolling load on a rolling mill, the limits of the torque from the main driving motor for the rolling mill, etc. Therefore, the conditions to be fulfilled by a standard expression for the re-distribution of the load to the first half of the stands are to uniformly distribute the rolling force to each stand in accordance with the rolling ability of each stand and as much as possible to avoid the concentration of the rolling force on a specified stand. For example, the following expression (6) may be applied thereto.

$$\frac{\Delta Pi-1}{Pi-1_{90}}=\frac{\Delta Pi}{Pio} \tag{6}$$

where

ΔPi−1 and ΔPi: changed components from initial values on (i−1)-th and i-th stands Pi−1, 0 and Pio: initial values of rolling force on (i−1)-th and i-th stands The expression (6) is used to re-distribute changed components of the load on each stand in accordance with a ratio between initial distributed loads. On the other hand, the initial distributed components of the load are determined by considering the operational property, the ability of each rolling mill, etc. According to this system, therefore, the re-distribution can be controlled to comply with the operator's intention of "distributing the load".

The foregoing has indicated two sorts of systems which are to be used as the standard for controlling the balance of a load, one of which is based on expressions (3) or (5) and the other of which is based on expression (6). Regarding practical rolling mills, it is desirable to use a system into which those two sorts of systems are combined on the basis of various parameters of the material. The expression (5) is principally applied to the first half of the stands while the expression (6) is principally applied to the second half of the stands, and the size of the rolled material, the type of steel, etc. determine what number of the stand draws a boundary of the application between these two expressions. Also, by introducing into the expressions (5) and (6) correction coefficients based on the operating conditions, the following expressions (7) result:

$$\left.\begin{array}{l}\dfrac{\Delta P1}{K_1P_{10}}=\dfrac{\Delta P2}{K_2P_{20}}=\ldots=\dfrac{\Delta Pl}{klPl_o}\\ \text{and}\\ \dfrac{\Delta Pl}{mlhl}=\dfrac{\Delta Pl+1}{ml+1hl+1}=\ldots=\dfrac{\Delta Pn}{mnhn}\end{array}\right\} \tag{7}$$

where $k_1$ to ke: correction coefficients for distribution of load to first half of stands ml to mn: correction coefficients for distribution of load to second half of stands l: number of stand providing the boundary of application between expressions (5) and (6)

n: number of the last stand

The $k_1$ to Ke, and ml to mn are coefficients (which are positive numbers approximating 1) for correcting the ratios between the stands in the standard expressions (5) and (6) within a constant range. The optimum values are determined in accordance with the operating conditions such as the size of a plate, the type of steel, etc. and are stored in divided strata.

The foregoing description has clarified the standard expressions for calculating the ratio of the re-distribution of the load in order to prevent the rolling force from concentration on a specified stand and also to maintain the shape of the final product. However, in order to realize the said-re-distribution of the rolling force by correcting each screw-down position on the continuous rolling mill, the calculation of the corrected quantities of the screw-down positions (roll openings) is determined by utilizing an equation of the rolling equilibrium based, for example, on coefficients of influence. As mill rolling equations, the following modeled expression (8) to (12) are used:

$$hi = hi(Si,\ Hi,\ tbi,\ tfi,\ ki,\ \mu i) \tag{8}$$

$$tbi = tfi - 1 \tag{9}$$

$$Hi = hi - 1 \tag{10}$$

$$hi = Si + Pi/Mi + \epsilon i \tag{11}$$

and $$Pi = Pi(ki,\ Wi,\ Hi,\ hi) \tag{12}$$

The expression (11) is a model of the gauge meter system and the expression (12) is a model of the rolling load. There are well known modeled expression according, for example, to Sims.

Here hi: exit gauge on i-th stand,
Si: roll opening,
Hi: entry gauge,
tbi and tfi: backward and frontward,
tensions, ki: average resistance to deformation,
$\mu$i: coefficient of friction,
Pi: rolling force,
Mi: coefficient of mill elasticity,
$\epsilon$i: correction term of gauge meter, and
Wi: plate width The control of this re-distribution of the load is executed according to a sampling control system as will be described hereinafter but the equation of the rolling equilibrium is applied to variations for a reduced short time interval (one sampling time period). Therefore, changes in the coefficient of friction $\mu$i and plate width Wi can be disregarded. Also, in the hot rolling, the control of a tension is effected by the looper and therefore changes in frontward and backward tensions tfi and tbi can be also disregarded. With those facts in view, variations of the expressions (8) and (12) result in the following expressions (13) and (14):

$$\Delta Pi = \left(\frac{\partial h}{\partial S}\right)_i \cdot \Delta Si + \left(\frac{\partial h}{\partial H}\right)_i \cdot \Delta Hi \tag{13}$$

and $$\Delta Pi = \left(\frac{\partial P}{\partial H}\right)_i \cdot \Delta Hi + \left(\frac{\partial P}{\partial h}\right)_i \cdot \Delta hi \tag{14}$$

Also from the expression (10)

$$\Delta Hi = \Delta hi - 1 \tag{15}$$

results where $\Delta$hi and $\Delta$Hi: minute variations in entry and exit gauges,
$\Delta$Si: minute variations in roll opening, $$\left(\frac{\partial h}{\partial S}\right)_i, \left(\frac{\partial h}{\partial H}\right)_i, \left(\frac{\partial P}{\partial H}\right)_i \text{ and } \left(\frac{\partial P}{\partial h}\right)_i : \text{coefficients of influence } (i\text{-th stand})$$

By substituting the expression (15) into the expressions (13) and (14) and re-arranging them successively from the first to the n-th stand, the variations $\Delta$hi and $\Delta$Pi in exit gauge and rolling load on each stand can be arranged into the following expressions (16) and (17) as functions of a variation in screw-down position on the preceding stand or its corresponding stand and a variation in entry gauge on the first stand.

$$\left.\begin{aligned} \Delta h_1 &= a_{11}\Delta Si + b_{11}\Delta H_1 \\ \Delta h_2 &= a_{21}\Delta S_1 + a_{22}\Delta S_2 + b_{21}\Delta H_1 \\ &\vdots \\ \Delta hn &= an_1\Delta S_1 + an_2\Delta S_2 + \ldots + annΔSn + bn_1\Delta H_1 \end{aligned}\right\} \tag{16}$$

and $$\left.\begin{aligned} \Delta P_1 r &= \alpha_{11}\Delta S_1 + \beta_{11}\Delta H_1 \\ \Delta P_2 r &= \alpha_{21}\Delta S_2 + \alpha_{22}\Delta S_2 + \beta_{21}\Delta H_1 \\ &\vdots \\ \Delta Pnr &= \alpha n_1\Delta S_1 + \alpha n_2\Delta S_2 + \ldots + \alpha nn\Delta Sn + \beta n_1\Delta H_1 \end{aligned}\right\} \tag{17}$$

where all of aij, bnj, $\alpha$ij and $\beta$nj are coefficients capable of being calculated from the coefficients of influence shown in the expressions (13) and (14) and may be calculated by using the modeled rolling expressions provided that a schedule for rolling the material is determined. Also, regarding variations in rolling force for the expressions (17), they are suffixed with r so as not to confuse them with the expressions (4) to (7).

By taking the case of a seven stand continuous hot rolling mill, the description will now be made in conjunction with calculating expressions for executing the control of the re-distribution of the rolling force by using the equilibrium equations (16) and (17).

Assuming that the expression (7) is used as the standard expression of the re-distribution of the rolling force, the introduction of a system according to the expressions (7) into the last three stands reduces the expressions (17) to the following expressions (18):

$$\frac{\Delta P_1}{k_1 P_{10}} = \frac{\Delta P_2}{k_2 P_{20}} = \frac{\Delta P_3}{k_3 P_{30}} = \frac{\Delta P_4}{k_4 P_{40}} = \frac{\Delta P_5}{k_5 P_{50}} \tag{18}$$

and $$\frac{\Delta P_5}{m_5 h_5} = \frac{\Delta P_6}{m_6 h_6} = \frac{\Delta P_7}{m_7 h_7}$$

Figure 4:
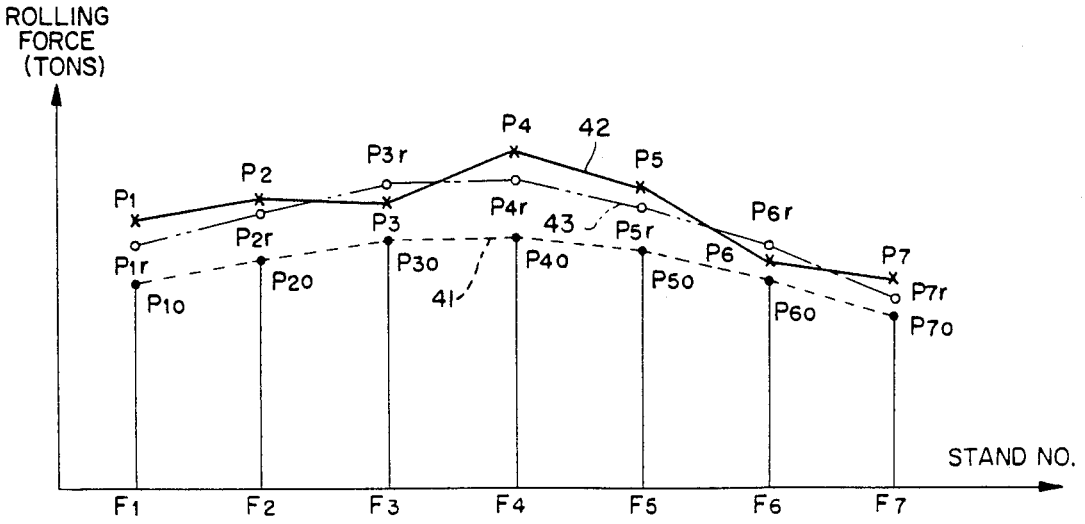
FIG. 4 is a diagram illustrating a graph of a distribution-of-rolling force pattern for the hot finish rolling mill.

It is now assumed that in FIG. 4, ($P_{10}$, $P_{20}$, . . . , $P_{70}$) at 41 designate an initial rolling load pattern and a rolling load pattern which is stored up to a time point where the shape is good after the passage of the plate. It is also assumed that the rolling proceeds and the present load pattern is designated by ($P_1$, $P_2$, . . . , $P_7$) at 42. On the contrary, it is assumed that an objective load pattern for the re-distribution of the load to be decided is designated by ($P_{1r}$, $P_{2r}$, . . . , $P_{7r}$) at 43. Each of the three load distribution patterns here defined has a variation to either of the remaining patterns defined by the following expressions (19), (20) or (21):

$$\Delta Pi = Pir - Pio \tag{19}$$

$$\Delta Pir = Pi - Pir \text{ or} \tag{20}$$

$$\Delta Pio = Pi - Pio = \Delta Pi + \Delta Pir \tag{21}$$

where i=1~7. ($\Delta$Pi's or $\Delta P_1$, $\Delta P_2$, . . . , $\Delta P_7$) shown in the expression (19) are variations in rolling force from the initial load pattern to the objective pattern for the re-distribution of the load and are required to fulfill the standard expression for the re-distribution of the rolling force in the expression (18). Since the expression (18) does not determine the absolute value of $\Delta$Pi (only the mutual ratios are determined), a new parameter xp is used to express the expression (18) by the following expression (22):

$$\Delta Pi = xp \cdot kiPio \ (i=1\sim7) \tag{22}$$

where for i=6 or 7, ki is defined by the following expression (23):

$$ki = k_5\left(\frac{mi}{m_5}\right)\left(\frac{hi}{h_5}\right)\left(\frac{P_{50}}{Pio}\right) \ (i = 6, 7) \tag{23}$$

On the other hand, $\Delta$Pir in the expression (20) designates a correction from the present load pattern to the objective load pattern for the re-distribution of the load on each stand and is required to coincide with $\Delta$Pir in the expression (17). From the expressions (21) and (22):

$$\Delta Pir = \Delta Pio - xp \cdot ki \cdot Pio \tag{24}$$

results where i=1~7. $\Delta$Pir in the expressions (17) and (24) is a variation in rolling force which is attempted to now be corrected. However, upon the occurrence of this variation in rolling force, it is desirable to control the final exit gauge of the product so as to always be of a given objective value in view of the maintenance of and the improvements in the quality of the gauge of the product. For example, if a gauge sensor on the exit side of the final stand measures a deviation of the present gauge from the objective gauge to be of $\Delta$hx, then a change in screw-down opening according to the expression (17) is controlled so that a change $\Delta$hn(n=7) in exit gauge on the last stand is equal to $-\Delta$hx. Accordingly, by substituting the expression (24) into the lefthand side of the expressions (17) and combining it with the expression for $\Delta h_7$ (with $\Delta h_7 = -\Delta hx$) in the expressions (16), the following expressions (25) result:

$$\left.\begin{array}{ll}
\alpha_{11}\Delta S_1 & +xpk_1P_{10} = \Delta P_{10} - \beta_{11}\Delta H_1 \\
\alpha_{21}\Delta S_1 + \alpha_{22}\Delta S_2 \ddots & +xpk_2P_{20} = \Delta P_{20} - \beta_{21}\Delta H_1 \\
\vdots & \vdots \\
\alpha_{71}\Delta S_1 + \alpha_{72}\Delta S_2 + \cdots + \alpha_{77}\Delta S_7 & +xpk_7P_{70} = \Delta P_{70} - \beta_{71}\Delta H_1 \\
a_{71}\Delta S_1 a_{72}\Delta S_1 a_{72} + \cdots + a_{77}\Delta S_7 & = -\Delta hx - b_{71}\Delta H_1
\end{array}\right\} \tag{25}$$

Alternatively, the expression by the matrix calculation results in the following expression (26):

$$\begin{bmatrix} \alpha_{11} & 0 \cdots 0 & k_1P_{10} \\ \alpha_{21} & \alpha_{22} \ddots 0 & k_2P_{20} \\ \vdots & \vdots & \vdots \\ \alpha_{71} & \alpha_{72} \cdots \alpha_{77} & k_7P_{70} \\ \alpha_{71} & \alpha_{72} \cdots \alpha_{77} & 0 \end{bmatrix} \times \begin{bmatrix} \Delta S_1 \\ \Delta S_2 \\ \vdots \\ \Delta S_7 \\ xp \end{bmatrix} = \begin{bmatrix} \Delta P_{10} - \beta_{11}\Delta H_1 \\ \Delta P_{20} - \beta_{21}\Delta H_1 \\ \vdots \\ \Delta P_{70} - \beta_{71}\Delta H_1 \\ -\Delta hx - b_{71}\Delta H_1 \end{bmatrix} \tag{26}$$

Therefore, values of $\Delta S_1$, . . . , $\Delta S_7$ and xp can be found according to the following expression (27):

$$\begin{bmatrix} \Delta S_1 \\ \Delta S_2 \\ \vdots \\ \Delta S_7 \\ xp \end{bmatrix} = \begin{bmatrix} \alpha_{11} & 0 \cdots 0 & k_1P_{10} \\ \alpha_{21} & \alpha_{22} \ddots 0 & k_7P_{20} \\ \vdots & \vdots & \vdots \\ \alpha_{71} & \alpha_{72} \cdots \alpha_{77} & k_7P_{70} \\ a_{71} & a_{72} \cdots a_{77} & 0 \end{bmatrix}^{-1} \times \begin{bmatrix} \Delta P_{10} - \beta_{11}\Delta H_1 \\ \Delta P_{20} - \beta_{21}\Delta H_1 \\ \vdots \\ \Delta P_{70} - \beta_{71}\Delta H_1 \\ -\Delta kx - b_{71}\Delta H_1 \end{bmatrix} \tag{27}$$

That is, when rolling roll opening on each stand is corrected by using $\Delta S_1$ to $\Delta S_7$ obtained according to the expression (27), the result of the re-distribution of the rolling force fulfills the expressions (18) for the objective ratios and it is possible to execute the control of the re-distribution of the rolling force. At the same time, the exit gauge on the last stand is also corrected so that the present error $\Delta$hx is cancelled and it is possible to also maintain the gauge of the product at the objective value.

Figure 5:
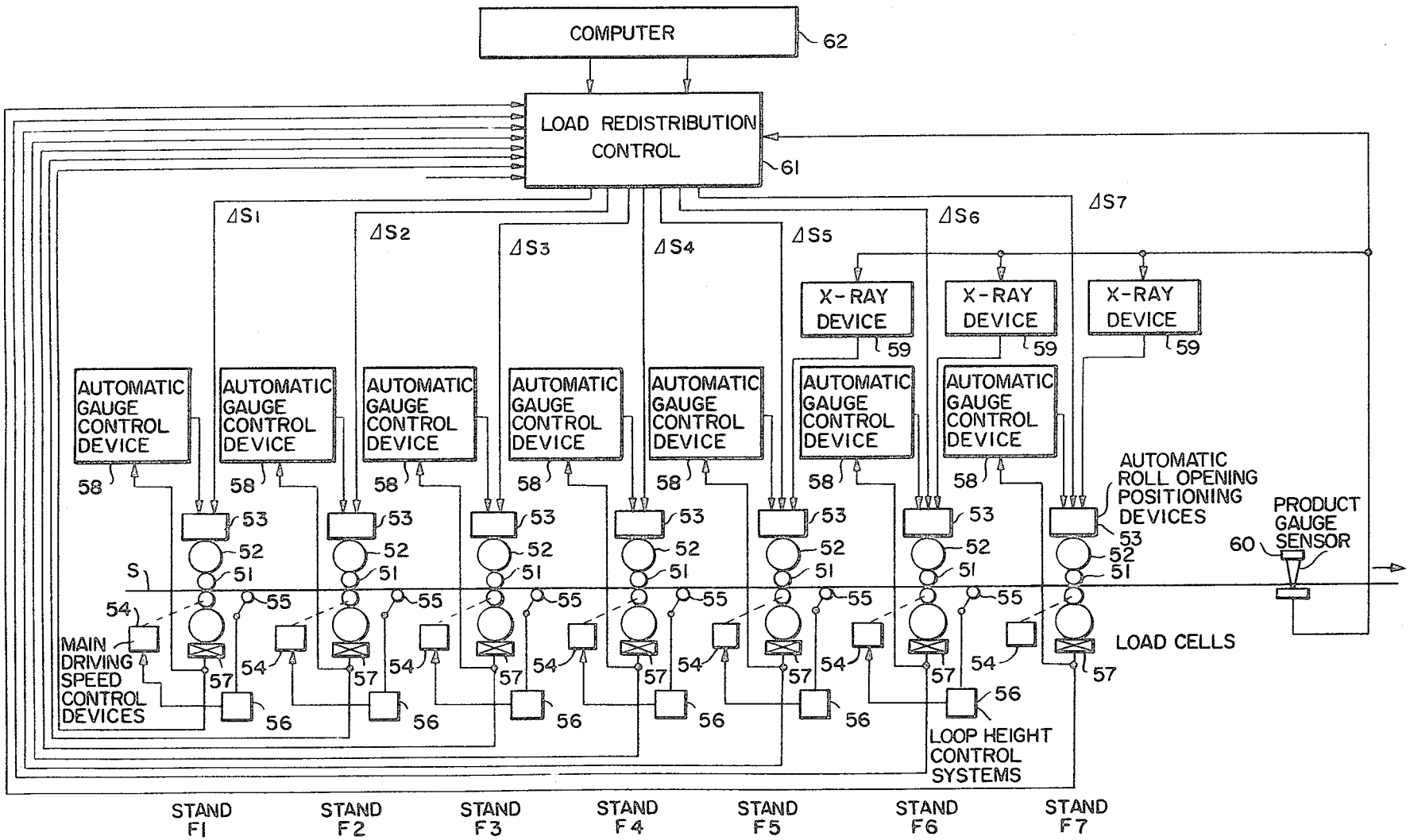
FIG. 5 is a structural view illustrating an embodiment of a re-distribution-of-load control apparatus.
Figure 6:
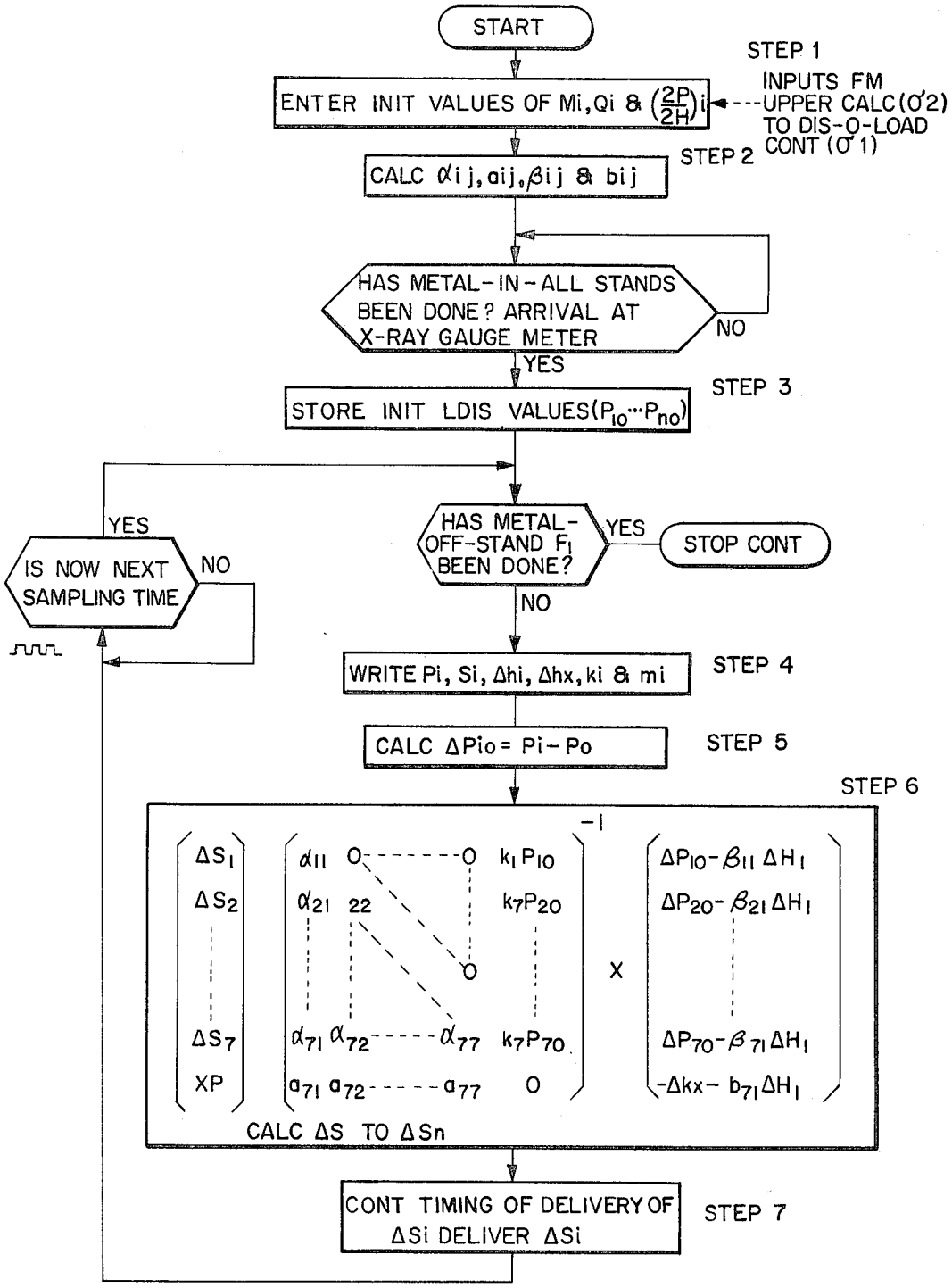
FIG. 6 is a flowchart of the operation of the control apparatus.

A concrete embodiment of the present invention as explained above is described in accordance with an example of a seven stand hot finish rolling mill in FIG. 5 and a flow chart shown in FIG. 6.

In FIG. 5, numerals 51 designate seven roll stands of a hot finish rolling mill; numeral 52 designates a backup roll; numeral 53 designates an automatic roll opening positioning device; numeral 54 designates a main driving speed control system for the rolling mill; numeral 55 designates a looper between the stands; numerical 56 designates a looper's height control system; numeral 57 designates a rolling force sensor (a load cell); numerical 58 designates an RF·AGC device; 59 designates an X-ray AGC device; numeral 60 designates a produt's gauge sensor; numeral 61 designates a device for controlling the re-distribution of a load according to the present invention; numeral 62 designates a computer for setting up the rolling mill and S designates a rolled material. As hardware for the device 61 for controlling the re-distribution of the load, a small-sized computer is preferably used but it is not restricted thereto. When the rolled material S approaches the $F_1$ stand, the setting-up computer 62 estimates a rolling reaction, a forward slip of the material relative to the rolling mill and other parameters for each stand of the finish rolling mill on the basis of the size of a rough slab material rolled by a roughing mill, the measured temperature thereof, etc. and by using models of numerical expression determines a screw-down opening, the speed of the rolling roll, etc. on each of the rolling mills thereby resulting in the pre-setting thereof. At that time, in the embodiment of the present invention, the setting-up computer 62 calculates simultaneously calculates values of the coefficients of influence $\alpha$ij, aij, $\beta$ij and bij required for the calculation of the expression (27) from modeled expressions or the like within the computer and also transmits them to the device 61 for controlling the re-distribution of the load along with the rolling parameters such as the absolute value of the exit gauge hi on each stand, the width, the type of steel and other parameters required for the device 61 for controlling the re-distribution of the load as data (the step 1 shown in FIG. 6). This control device 61 selects the coefficients in the standard expressions (18) and the like on the basis of the received parameters of the rolled material (the gauge, width and type of steel) (the step 2 shown in FIG. 6). When the rolled material S from the $F_1$ stand is gripped successively by the $F_2$ to $F_7$ stands, the RF·AGC device 58 stores an initial value of the exit gauge on the corresponding stand as a reference value and initiates the control of the gauge. Also, upon the strip S reacting the product's gauge sensor 60, the operator decides whether or not the shape (the flatness) is good and correct the screw-down opening or a roll bender as occasion calls to maintain a good shape. At that time point, the rolling force on each of the roll stands is stored in the device 61 for controlling the re-distribution of the load as an initial load distribution pattern Pio (the step 3 shown in FIG. 6) and the re-distribution of the load is initiated so as to be controlled. This control is carried out by the sampling control and the rolling force Pi on each stand and a deviation of the sensor $\Delta hx$ is read out at the beginning of each sampling (the step 4 shown in FIG. 6). In order to re-distribute the rolling load on the basis of the expression (27), a correction $\Delta Si$ ($i=1\sim7$) of the screw-down position is calculated (the steps 5 and 6 shown in FIG. 6). Here $\Delta Hi$ (a deviation of the entry gauge on the Fi) required for the calculation of the expression (27) is used by according in timing with the rolling of the material after its measured values on a rough rolling mill have been preliminarily stored in a memory of the device 61 for controlling the re-distribution of the load.

The correction of the screw-down position is delivered to the automatic positioning device 53 by adjusting the timing with the speed of movement of the material through $F_1$, $F_2$, . . . and $F_7$ (the step 7 shown in FIG. 6) and the screw-down position is corrected. As a result, the distribution of the rolling force changes the pattern from Pi to Pir in FIG. 4. At the time point when a gauge change point due to this correction of the screw-down position reaches the sensor 60, this sampling is completed so as to shift to the next succeeding sampling after which this sampling is repeated until the material S passes through the $F_1$ stand. While the device 61 for controlling the re-distribution of the load has the function of also maintaining the exit gauge on the last stand, the X-ray AGC device 59 is provided for the purpose of absorbing errors in the coefficients of influence. However, that function is now nothing but an auxiliary means for the device 61 for controlling the re-distribution of the load.

Also, while the present invention has used the expressions (3), (5), (6) and (7) as the standard expressions for the rolling load for purposes of explanation, the standard expressions are not restricted thereto and systems similar thereto are included in the scope of the claims.

The present invention is not restricted to continuous hot finish rolling mills and is applicable, for example, to tandem cold mills.

I claim:

1. An apparatus for controlling the re-distribution of a load on a continuous rolling mill comprising:

a plurality of roll stands for successively rolling a rolled material;

a rolling force sensor means disposed at each of said roll stands for sensing a rolling load thereon;

a rolled material product gauge sensor for sensing an exit gauge at a last roll stand of said plurality of roll stands;

an automatic roll opening positioning means for each of said plurality of roll stands for controlling a roll opening of its corresponding roll stand;

a memory means for storing therein a ratio of reference rolling forces Pio with respect to said plurality of roll stands or a ratio of reference exit gauges hi between pairs of said plurality of roll stands when said plurality of roll stands are at their optimum rolling conditions for rolling said rolled material; and a screw-down correction computer means for calculating a roll opening Si at each of said plurality of roll stands so that a deviation $\Delta Pi$ in a reference rolling force Pio at each of said plurality of stands from an actual rolling force Pir sensed by its corresponding rolling force sensor means is maintained at said corresponding ratio of reference rolling forces stored in said memory means and so that an exit gauge at said last roll stand is equal to a desired gauge, and for delivering each of said calculated roll openings to its corresponding automatic roll opening positioning means.

2. An apparatus for controlling the re-distribution of a load on a continuous rolling mill as claimed to claim 1, wherein said screw-down correction computer means calculates said roll openings at a first group of roll stands selected from said plurality of roll stands by using said ratio of reference rolling forces of said first group of stands and delivers said calculated rolling openings to corresponding automatic roll opening positioning means operatively associated with said first group of stands, and wherein said screw-down correction computer means calculates the rolling openings at other stands of said plurality of stands by using the ratio of reference exit gauges of said other stands and delivers said calculated rolling openings to corresponding automatic roll opening positioning means operatively associated with said other stands.

* * * * *